US006539906B2

(12) United States Patent
Rado et al.

(10) Patent No.: US 6,539,906 B2
(45) **Date of Patent: *Apr. 1, 2003**

(54) MECHANICAL COMPRESSION AND VACUUM RELEASE

(75) Inventors: Gordon E. Rado, Brookfield, WI (US); Leonard E. Gescheidle, Rhinelander, WI (US)

(73) Assignee: Tecumseh Products Company, Tecumseh, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/821,875

(22) Filed: Mar. 30, 2001

(65) Prior Publication Data

US 2002/0139339 A1 Oct. 3, 2002

(51) Int. Cl.[7] ..... F02N 17/00
(52) U.S. Cl. ..... 123/179.18; 123/182.1
(58) Field of Search ..... 123/179.18, 182.1

(56) References Cited

U.S. PATENT DOCUMENTS

| | | | | |
|---|---|---|---|---|
| 2,999,491 | A | 9/1961 | Harkness | 123/182 |
| 3,306,276 | A | 2/1967 | Harkness et al. | 123/182 |
| 3,362,390 | A | 1/1968 | Esty | 123/182 |
| 3,395,689 | A | 8/1968 | Kruse | 123/182 |
| RE26,462 | E | 9/1968 | Harkness et al. | 123/182 |
| 3,511,219 | A | 5/1970 | Esty | 123/812 |
| 3,897,768 | A | 8/1975 | Thiel | 123/182 |
| 3,981,289 | A | 9/1976 | Harkness | 123/182 |
| 5,301,643 | A | 4/1994 | Garcyalny | 123/198 D |
| 5,317,999 | A | 6/1994 | Kern et al. | 123/182.1 |
| 5,497,735 | A | 3/1996 | Kern et al. | 123/90.6 |
| 5,687,683 | A | 11/1997 | Knoblauch | 123/182.1 |
| 5,809,958 | A | 9/1998 | Gracyalny | 123/182.1 |
| 5,823,153 | A | 10/1998 | Santi et al. | 123/182.1 |
| 5,957,097 | A | 9/1999 | Schanz | 123/90.17 |
| 5,992,367 | A | 11/1999 | Santi et al. | 123/182.1 |
| 6,055,952 | A | 5/2000 | Gau | 123/182.1 |
| 6,394,054 | B1 * | 5/2002 | Rado et al. | 123/182.1 |

FOREIGN PATENT DOCUMENTS

| | | |
|---|---|---|
| EP | 0 515 183 | 11/1992 |
| GB | 1243551 | 8/1971 |
| WO | WO 01/61157 | 8/2001 |

* cited by examiner

*Primary Examiner*—Gene Mancene
*Assistant Examiner*—Arnold Castro
(74) *Attorney, Agent, or Firm*—Baker & Daniels

(57) ABSTRACT

A four-stroke internal combustion engine includes a cylinder block including a cylinder therein and having a piston reciprocally disposed within the cylinder. A piston is operably engaged with a crankshaft. At least one intake valve is reciprocally driven by a camshaft. At least one exhaust valve is reciprocally driven by the camshaft. A vacuum release mechanism includes an operating member reciprocally supported within the camshaft for translation along an axis. A centrifugally actuated flyweight member is engaged with the operating member, wherein rotation of the camshaft above engine cranking speeds causes the flyweight member to move the operating member from a first position to a second position. A vacuum release member is movably supported within the camshaft and is in engagement with the operating member wherein translational movement of the operating member causes movement of the vacuum release member. The operating member and flyweight are urged to the first position at engine cranking speeds and moved by the flyweight member through centrifugal force to the second position at engine running speeds. The vacuum release member is in lifting engagement with one of the valves at the first position during at least a portion of the power stroke of the piston and out of lifting engagement with one of the valves at the second position.

20 Claims, 6 Drawing Sheets

MECHANICAL COMPRESSION AND VACUUM RELEASE

BACKGROUND OF THE INVENTION

1. Field of the Invention

This invention generally relates to internal combustion engines, and more particularly to a compression release and vacuum release mechanism for four-stoke cycle engines.

2. Description of the Related Art

Compression release mechanisms for four-stroke cycle engines are well known in the art. Generally, means are provided to hold one of the valves in the combustion chamber of the cylinder head slightly open during the compression stroke while cranking the engine. This action partially relieves the force of compression in the cylinder during starting, so that starting torque requirements of the engine are greatly reduced. When the engine starts and reaches running speeds, the compression release mechanism is rendered inoperable so that the engine may achieve full performance. It is normally advantageous for the compression release mechanism to be associated with the exhaust valve so that the normal flow of the fuel/air mixture into the chamber through the intake valve, and the elimination of spent gases through the exhaust valve is not interrupted, and the normal direction of flow through the chamber is not reversed. Examples of compression release mechanisms for four-stroke engines are numerous and share a common principle which includes activating a valve displacement feature at low crankshaft speeds, i.e., at startup, and deactivating the same at significantly higher crankshaft speeds i.e., run mode.

Presently, conventional four-stoke engines require a significant amount of torque to turn the engine over during the power stroke when combustion is not taking place. This is so because the piston is then moving downwardly against a pressure difference due to increasing suction resulting from the partial discharge of gas from the cylinder during the immediately preceding compression stroke. The increase of torque required corresponds to a substantial operator or starter force required to drive the piston downwardly against that pressure difference.

In response to the torque developed by suction, one prior art combustion engine suggests using a contoured cam lobe which acts to hold the valve open longer between the compression and power strokes. Starting torque was decreased by this mechanism, however compression and accordingly engine power would significantly decrease compared to conventional engines which employ the traditional "pear-shaped" cam lobes. Yet another prior art mechanism employed a light spring placed on the stem side of the exhaust valve to hold the valve open during start-up. However, significant intake and exhaust manifold pressures would be required to close the exhaust valve and thus longer times and increased user effort is required to start the engine.

Other devices which compensate for torque caused as a result of suction force developing during the power stroke are disclosed in provisional Patent Application No. 60/231,818, filed Sep. 11, 2000, and Patent Application No. 09/760,953, filed Jan. 15, 2001, both of which are assigned to the assignee of the present application, the disclosures of which are expressly incorporated herein by reference.

The device disclosed in provisional Patent Application No. 60/231,818, utilizes a saddle member pinned to an accessible area of the camshaft and includes a pair of auxiliary cams to sequentially relieve compression and vacuum by lifting the exhaust valve during appropriate portions of the compression and power stroke at engine cranking speeds. The device disclosed in patent application Ser. No. 09/760,953, utilizes an operating member, rotatably fixed along the length of the camshaft, having a compression relieving operating end in engagement with a vacuum release member to sequentially relieve compression and vacuum by lifting the exhaust valve during appropriate portions of the compression and power stroke at engine cranking speeds.

Although effective, the saddle type device is not readily adaptable to some existing engine designs. Traditionally used engine crankcase designs require casting and machining modifications before this release may be implemented. Similarly, the operating shaft type device requires significant additional machining or casting modification to the camshaft to accommodate this release.

Accordingly, it is desired to provide a release mechanism that addresses the significant torque developed by both the compression and power strokes and one that is effective in operation and relatively simple in construction. It is further desired to provide a release mechanism which addresses this significant torque, and is retrofittable to a substantial number of existing engine crankcases without significant modification to the engine.

SUMMARY OF THE INVENTION

The present invention overcomes the disadvantages of prior internal combustion engines by providing a mechanical compression and vacuum release, of simple construct, including an operating member reciprocally supported within a camshaft and engaged with a centrifugally activated flyweight wherein movement of the centrifugal flyweight causes radial translation of a vacuum release member through the operating member and the vacuum release member is in lifting engagement with one of the intake or exhaust valves.

A four-stroke internal combustion engine is provided and includes a cylinder block having a cylinder therein and a piston reciprocally disposed within the cylinder. The piston is operably engaged with a crankshaft. At least one intake valve and exhaust valve are reciprocally driven by a camshaft. A vacuum release mechanism includes an operating member reciprocally supported within the camshaft for translation along an axis. A centrifugally actuated flyweight member is engaged with the operating member and rotation of the camshaft above engine cranking speeds causes the flyweight member to move the operating member from a first position to a second position. A vacuum release member is movably supported within the camshaft and in engagement with the operating member wherein translational movement of the operating member causes movement of the vacuum release member. The operating member and flyweight are urged to the first position at engine cranking speeds and are moved by the flyweight member through centrifugal force to the second position at engine running speeds. The vacuum release member is in lifting engagement with one of the valves at the first position during at least a portion of the power stroke of the piston and is out of lifting engagement with one of the valves at the second position.

The present invention further provides a compression release mechanism. The compression release member is movably supported within the camshaft and is in lifting engagement with one of the valves at the first position coinciding with at least a portion of the compression stroke of the piston. The compression release member and the vacuum release member successively attain lifting engagement with one of the valves at the first position and the compression and vacuum release members are out of lifting engagement with one of the valves at the second position.

An object of the present invention is to provide an engine having a mechanical vacuum release mechanism that overcomes substantial operator or starter force caused by suction forces acting on the piston during the power stroke at engine cranking speeds.

Another object of the present invention is to provide a compression and vacuum release mechanism easily retrofittable with existing engines crankcases wherein the release mechanism is disposed within the profile of the existing camshaft assembly. These and other objects, advantages and features are accomplished according to the devices, assemblies and methods of the present invention.

BRIEF DESCRIPTION OF THE DRAWINGS

The above mentioned and other features and objects of this invention will become more apparent and the invention itself will be better understood by reference to the following description of an embodiment of the invention taken in conjunction with the accompanying drawings, wherein.

Figure 1:
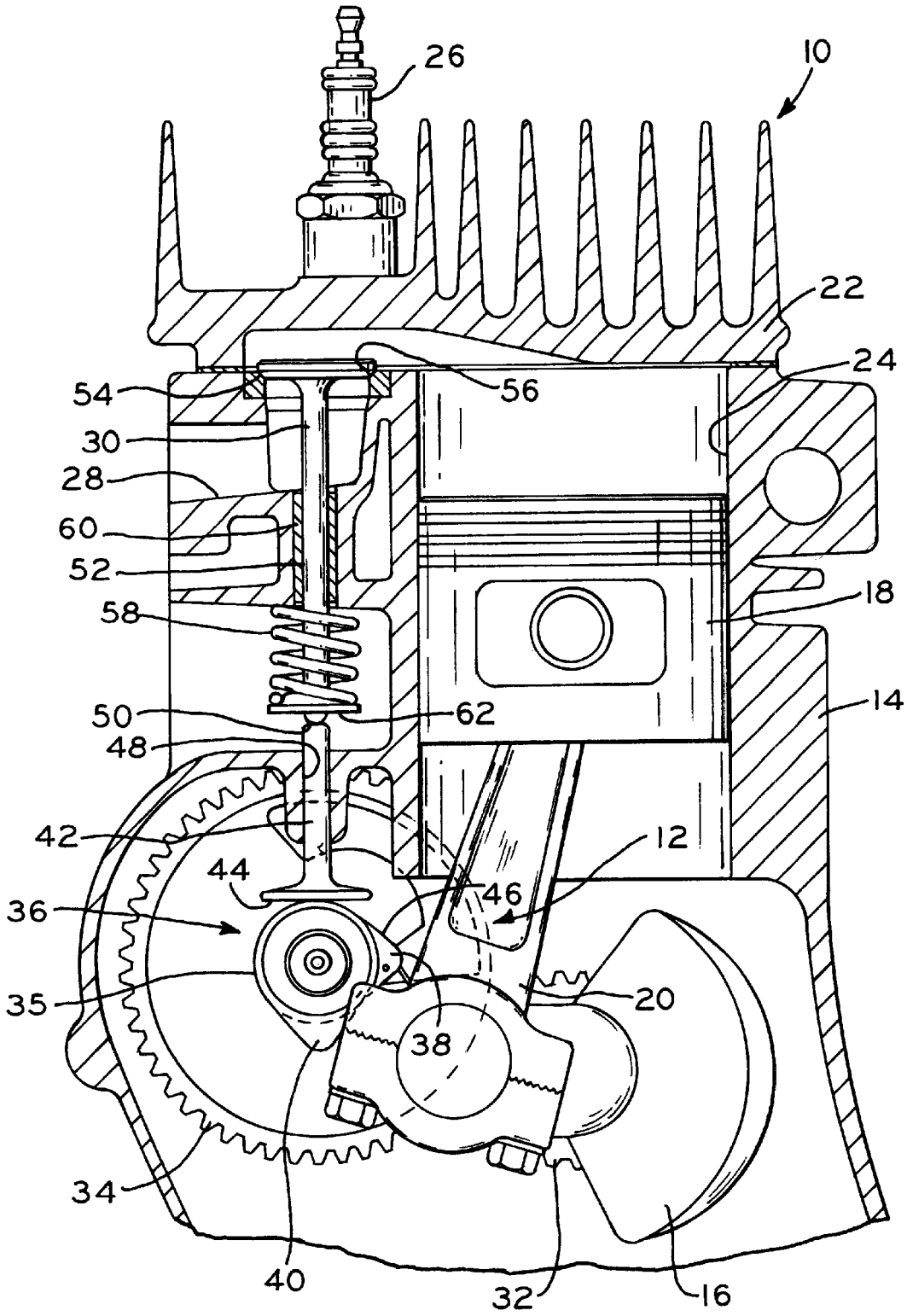
FIG. 1 is a sectional view of a single cylinder four-stroke internal combustion engine that incorporates a mechanical compression and vacuum release device in accordance with the principles of the present invention.

Corresponding reference characters indicate corresponding parts throughout the several views. Although the drawings represent an embodiment of the present invention, the drawings are not necessarily to scale and certain features may be exaggerated in order to better illustrate and explain the present invention.

DETAILED DESCRIPTION OF THE INVENTION

Referring now to the drawings and particularly to FIG. 1, there is shown a single cylinder, four-stroke internal combustion engine 10 including a mechanical compression and vacuum release mechanism 12 according to the present invention. Engine 10 includes cylinder block 14, crankshaft 16 and piston 18, the piston being operatively connected to crankshaft 16 through connecting rod 20. Piston 18 coacts with cylinder block 14 and cylinder head 22 to define combustion chamber 24. Spark plug 26, secured in cylinder head 22, ignites the fuel/air mixture after it has been drawn into combustion chamber 24 through an intake valve (not shown) during the intake stroke and has been compressed during the compression stroke of piston 18. The spark is normally timed to ignite the fuel/air mixture just before piston 18 completes its ascent on the compression stroke. The fuel/air mixture is drawn into combustion chamber 24 from the carburetor of the engine through an intake passage controlled by the intake valve, and the products of combustion are expelled from the cylinder during the exhaust stroke through exhaust port 28 controlled by poppet-type exhaust valve 30. Although either exhaust or intake valve may be opened to vent compression and vacuum during start-up, it is recognized that preferably exhaust valve 30 cooperates with the compression and vacuum release mechanism 12 in a manner to be discussed hereinafter.

Other conventional parts of the valve operating mechanism include timing gear 32 mounted on crankshaft 16 for rotation therewith, and camshaft assembly 36 which includes lobed camshaft 35 and circular camshaft gear 34 rotatably driven by timing gear 32 to thereby rotate camshaft 35 at one-half crankshaft speed. Camshaft 35 comprises conventional pear-shaped exhaust and intake camshaft lobes 38 and 40, respectively, (FIGS. 1 and 2) which rotate with camshaft 35, along axes of rotation 37 (FIG. 2), to impart reciprocating motion to the intake and exhaust valves via intake or cam follower (not shown) and exhaust cam follower 42, respectively. Although FIG. 1 illustrates the compression and vacuum release mechanism in a side valve engine, this is but one engine type, and it is envisioned that the compression and vacuum release mechanism is amenable to other engine types, such as OHV and OHC engines, for example, and either vertical or horizontal shaft orientations. Additionally, multiple compression and vacuum releases according to the present invention may be employed on an engine having multiple cylinders, such as a V-twin cylinder engine, for example.

The exhaust valve train is shown in FIG. 1 and includes exhaust cam follower 42 having face 44 adapted to bear tangentially against, and remain in a continuous tracking relationship with, peripherally located bearing surface 46 of exhaust camshaft lobe 38. Cam follower 42 slides in guide boss 48 of block 14, and its upper end pushes against tip 50 of valve 30. In operation, cam follower 42 lifts stem 52 of exhaust valve 30 which lifts face 54 of valve 30 from valve seat 56. Valve spring 58 encircles stem 52 between valve guide 60 and spring retainer 62. Spring 58 biases valve 30 closed and also biases cam follower 42 into tracking contact with surface 46 of exhaust lobe 38.

Figure 2:
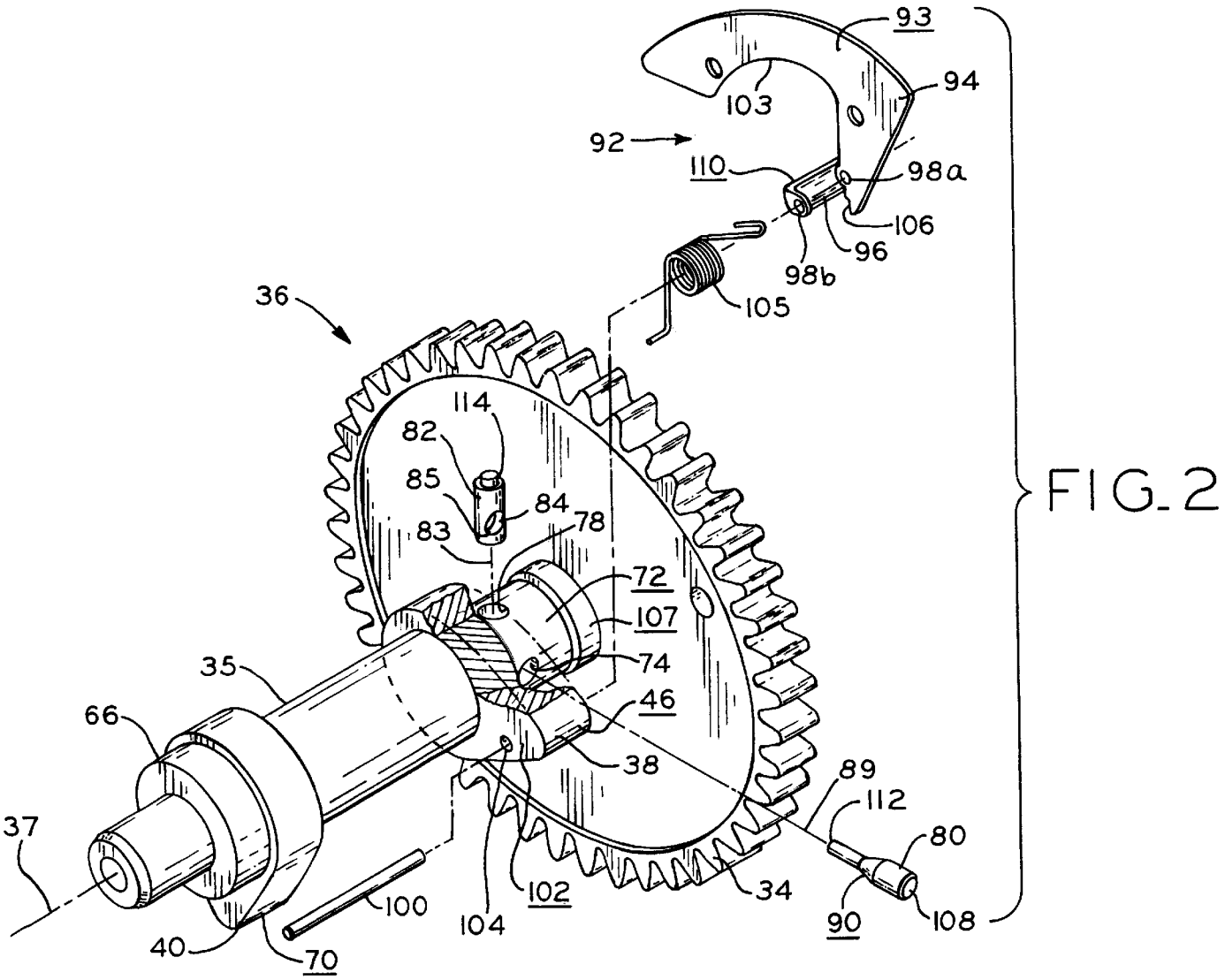
FIG. 2 is an exploded view of the camshaft and mechanical compression and vacuum release device of FIG. 1, showing the cam lobe partially fragmented to reveal camshaft structure accommodating the vacuum and compression release pins.
Figure 3:
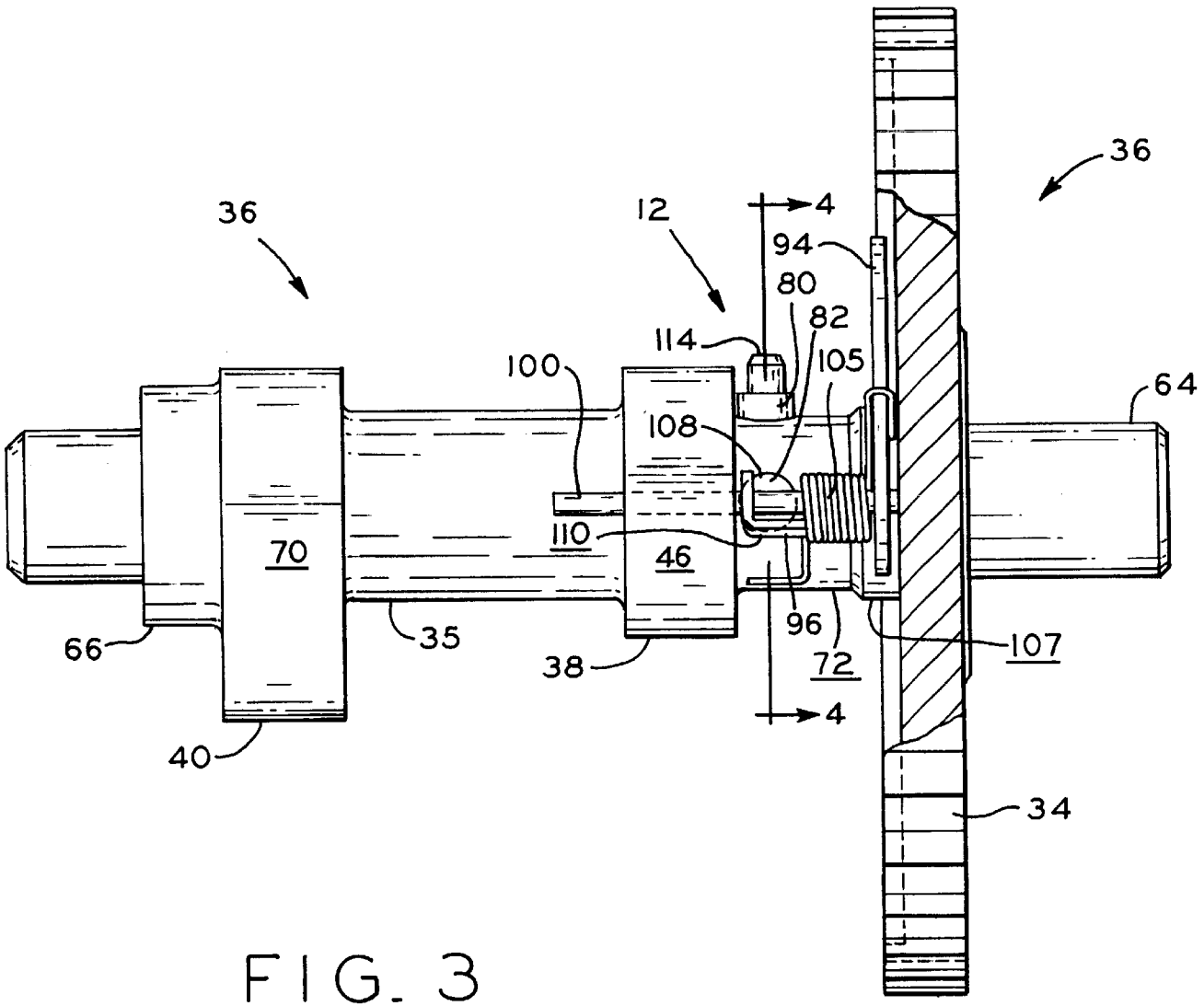
FIG. 3 is a plan view of the camshaft and mechanical compression and vacuum release device of FIG. 1, showing the vacuum release pin extended outside of the profile of the cam lobe corresponding to engine startup.

Referring to FIGS. 2–3, camshaft assembly 36 includes disk-shaped camshaft gear 34 and elongate camshaft 35 extending axially through camshaft gear 34. Camshaft 35 includes first end 64 (FIG. 3) axially extended through a lateral surface of camshaft gear 34 and second end 66 outwardly extended relative to that of first end 64. First and second ends 64, 66 of camshaft 35 are rotatably supported by engine block 14 through respective bearing assemblies, as is customary. Referring to FIG. 2, camshaft gear 34 and camshaft 35 are typically a single powder metal, forged, or injection molded component which has axis of rotation 68. Camshaft 35 includes the pear-shaped exhaust and intake lobes 38, 40. Exhaust and intake lobes 38, 40 are provided with respective bearing surfaces 46, 70 which are in a continuously engaged relationship with respective followers (exhaust valve follower 42 shown in FIG. 1).

Figure 4A:
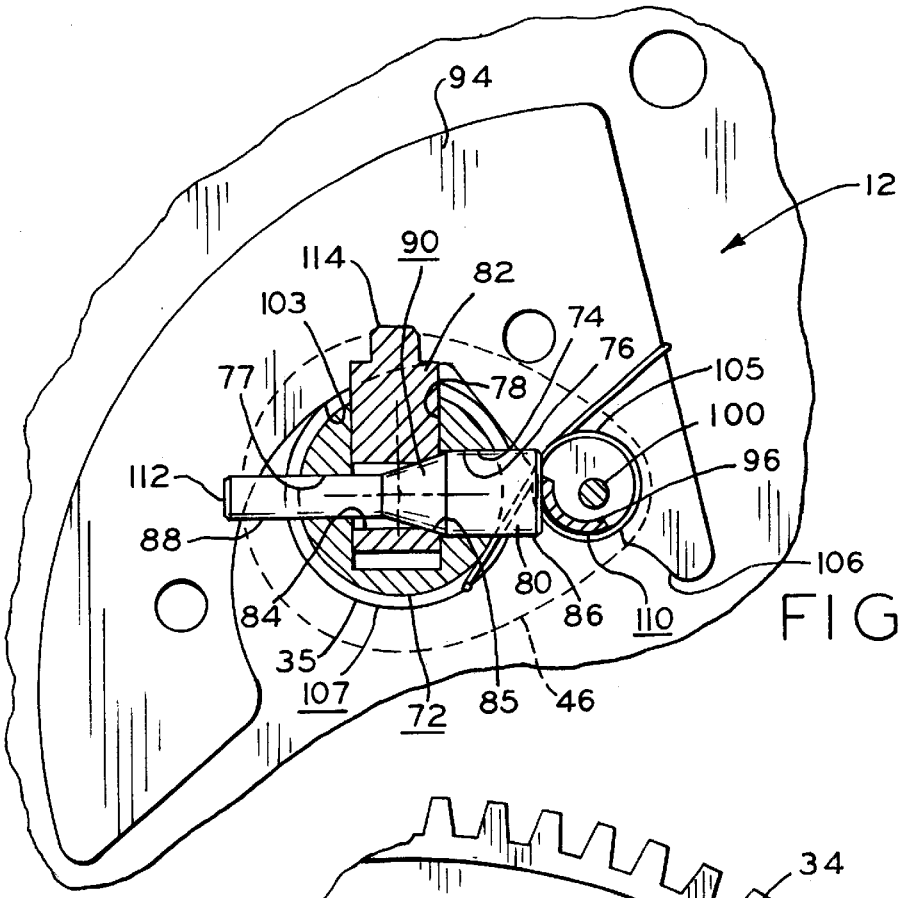
FIG. 4A is a fragmentary sectional view of the camshaft and mechanical compression and vacuum release device taken along line 4—4 of FIG. 3, illustrating the compression and vacuum release assembly in the startup position with the vacuum and compression release pins outwardly extended beyond the profile of the cam lobe.
Figure 4B:
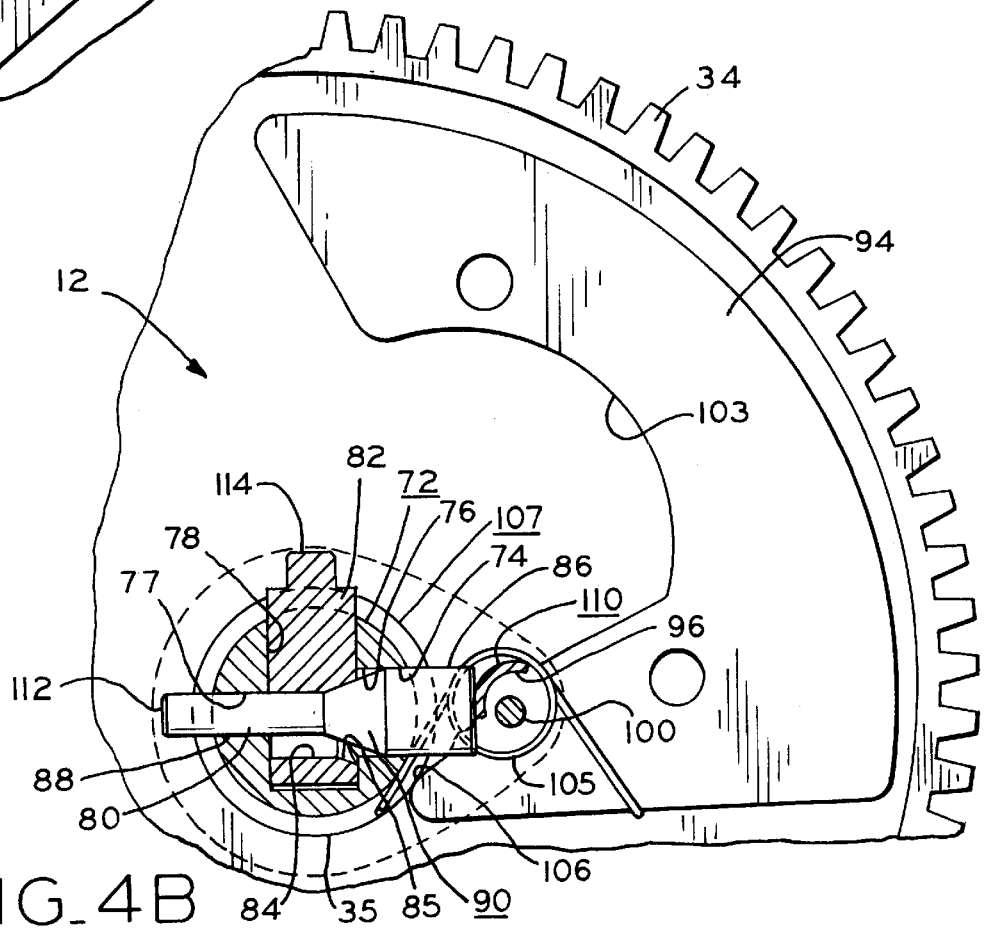
FIG. 4B is a fragmentary sectional view of the camshaft and mechanical compression and vacuum release device taken along line 4—4 of FIG. 3, illustrating the compression and vacuum release assembly in the run position with the vacuum and compression release pins receded beneath the profile of the cam lobe and the flyweight is outwardly pivoted.

Referring to FIG. 3, camshaft 35 includes a cylindrical outer surface 72 which includes a first hole 74, having a stepped profile, extended through surface 72 of cam 35. Referring to FIGS. 4A, 4B, stepped hole 74 is defined by cylindrical first inner surface 76 and second inner surface 77. Second inner surface 77 includes a diameter which is smaller than first inner surface 76. A second hole or crossbore 78 is provided within outer surface 72 of camshaft 35, however is held to a depth, so as not to completely extend through camshaft 35. An operating member or compression release pin 80 loosely fits within first hole 74 of camshaft 35 such that it is reciprocally supported by wall portions 76, 77. Vacuum release pin 82 is loosely fitted within crossbore 78 and includes a diameter slightly smaller than that of crossbore 78 within camshaft 35 such that vacuum release pin 82 freely reciprocates therein.

Vacuum release pin 82 coacts with compression release pin 80 to provide vacuum release to engine 10 as hereinafter described. Vacuum release pin 82 includes an aperture 84 radially positioned within pin 82 and a contoured edge 85, such as a chamfer, for example, provided within pin 82 at the entrance of aperture 84. Compression release pin 80 includes first end 86, second end 88 and a frustoconical operating surface 90 located intermediately therebetween. Second end 88 includes a smaller diameter, relative to first end 86 of compression release pin 80, and corresponding ends 86, 88 are respectively reciprocally guided by inner surfaces 76, 77 of camshaft 35 along axis of translation 89 (FIG. 2). Compression release pin 80 extends through aperture 84 within vacuum release pin 82 and it may be seen that movement of pin 80 urges movement of pin 82 along a second axis 83 (FIG. 2). Specifically, compression release pin 80 acts as an operator on vacuum release pin 82 through translational movement of operating surface 90 as it engages contoured edge 85 of vacuum release pin 82. As a result, vacuum release pin 82 radially extends as operating surface 90 of compression release pin 80 engages contoured edge 85 of vacuum release pin 82.

Referring to FIG. 2, compression and vacuum release mechanism 12 includes flyweight assembly 92 having sickle-shaped flyweight 94 provided with cammed portion 96 projecting outwardly from lateral surface 93 of flyweight 94. Cammed portion 96 includes first hole 98*a* extending through lateral surface 93 of flyweight 94 and second through hole 98*b* spaced apart and aligned relative to first hole 98*a*. Holes 98*a* and 98*b* are slightly larger in diameter than post 100 to facilitate uninterrupted rotation of flyweight 94 about post 100. Flyweight 94 is attached to and rotatably supported by cam lobe 38 through post 100. Post 100 interferingly fits within through hole 104 in lateral surface 102 of cam lobe 38. Flyweight assembly 92 also includes a torsion spring 105, as best shown in FIGS. 2 and 3, which biases flyweight 94 toward camshaft 35 such that inner stop edge 103 of flyweight 94 abuts an annular stop surface 107 of camshaft 35 when the engine is in the start-up condition (i.e., no centrifugal force exerted on flyweight 94).

Referring to FIG. 2, compression and vacuum release mechanism 12 may be assembled to camshaft assembly 36 as follows: vacuum release pin 82 is inserted into hole 78; compression release pin is inserted into its corresponding hole 74 in camshaft 35 with end 112 extended through aperture 84 in vacuum release pin 82; torsion spring 105 is placed on cammed portion 96 of flyweight 94; and flyweight assembly 92 is attached to camshaft assembly 36 by first aligning holes 98*a*, 98*b* of flyweight 94 with hole 104 in cam lobe 38 and pressing pin 100 through aligned holes 98*a*, 98*b* and 104 to attach flyweight assembly with camshaft assembly 36. Notably, and as best shown in FIGS. 4A, 4B, once assembled, compression release pin 80 is retained between cammed portion 96 of flyweight 94 and camshaft 35 and vacuum release pin 82 is retained by end 112 of compression release pin 80 extended therethrough.

As best seen in FIG. 4A, flyweight 94 is depicted in a first position corresponding to a start-up or cranking mode of the engine. In contrast, flyweight 94 is depicted in a second position as shown in FIG. 4B, corresponding to a run mode of the engine. Specifically, with reference to FIG. 4B, significant camshaft rotation causes centrifugal force to affect flyweight 94 and as a result flyweight 94 is influenced to its radially outward position. At this position stop edge 106 on flyweight 94 contacts annular stop base 107 of cam 35 to limit radial movement of flyweight 94.

In the engine cranking position depicted in FIG. 4A, cam portion 96 of flyweight 94 urges outward extension of compression release pin 80 due to face 108 of pin 80 being in tracking engagement with surface 110 of cam portion 96. Vacuum release pin 82 includes lifting portion 114 which is urged radially, outwardly by follower surface 90 of compression release pin 80 engaging contoured edge 85 of vacuum release pin 82 as illustrated in FIG. 4A. In contrast when the engine is in the run condition outward swinging movement of flyweight 94 results in cam surface 110 moving away from face 108 of compression release pin 80, and as a result, compression release pin 80 is. urged below bearing surface 46 of cam lobe 38 as lifting portion 112 of compression release pin 80 is contacted by cam follower 42 (FIG. 1).

Figure 5A:
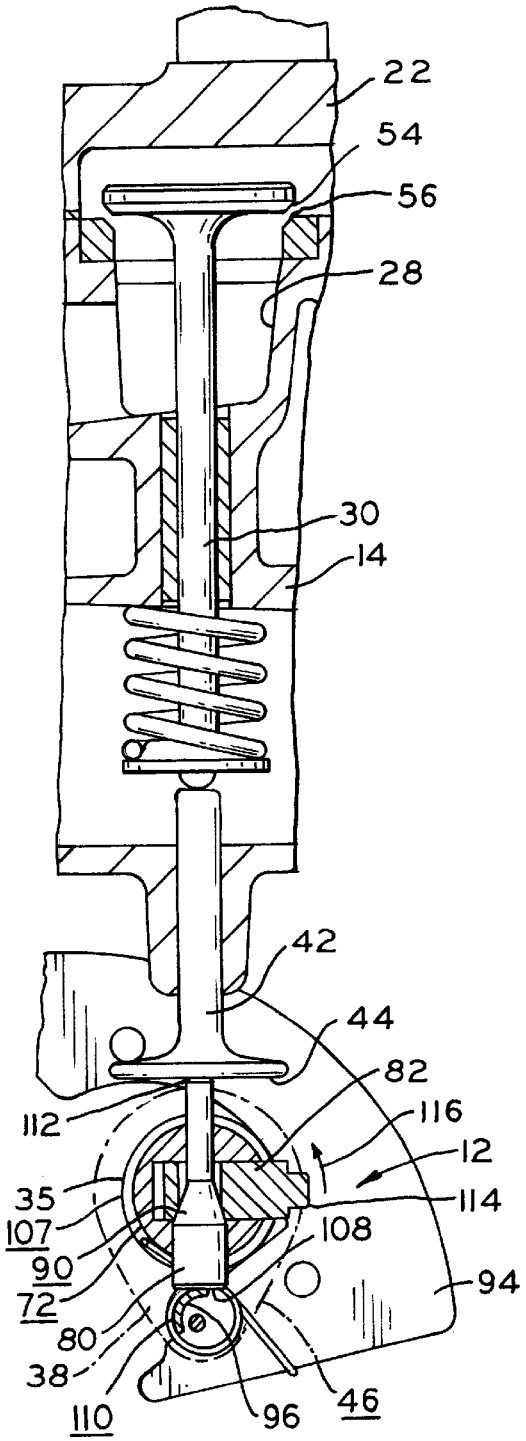
FIG. 5A is a fragmentary sectional view of the engine shown in FIG. 1, illustrating the compression and vacuum release assembly in the startup position, depicting the compression release pin in an extended position to relieve pressure formed in the cylinder.
Figure 5B:
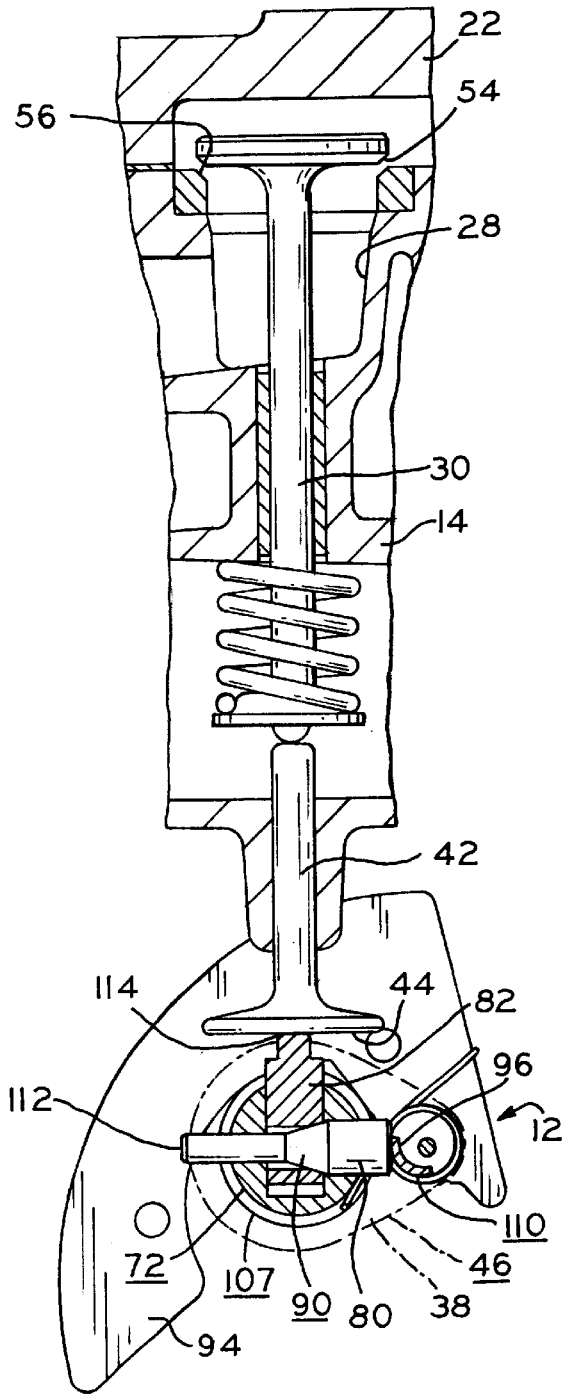
FIG. 5B is a fragmentary sectional view of the engine shown in FIG. 1, illustrating the compression and vacuum release assembly in the startup position, depicting the vacuum release pin in an extended position to relieve vacuum formed in the cylinder.

Compression and vacuum release mechanism 12 reduces start-up force caused by compression and vacuum successively acting on piston 18 as hereinafter described. Referring to FIG. 5A, it may be seen that surface 110 of cammed portion 96 of flyweight assembly 92 imposes an outwardly extended position on lift portion 112 of compression release pin 80. Consequently, compression release pin 80 displaces follower 42 which displaces exhaust valve 30, and as a result, face 54 of valve 30 is lifted off its seat 56 to thereby allow built up compressed gas within the cylinder to escape during a portion of the compression stroke. Referring to FIG. 5B, which illustrates camshaft assembly 36 rotated approximately 90 degrees in a counterclockwise rotational direction, as indicated by arrow 116 in FIG. 5A, it may be seen that lift portion 114 of vacuum release pin 82 is in lifting engagement with cam follower 42 and valve 30 is lifted off its seat to thereby diminish suction forces acting on piston 18 during at least a portion of the power stroke. Notably, corresponding to a camshaft rotation between the positions depicted in FIGS. 5A and 5B, valve 30 is preferably closed.

Figure 6:
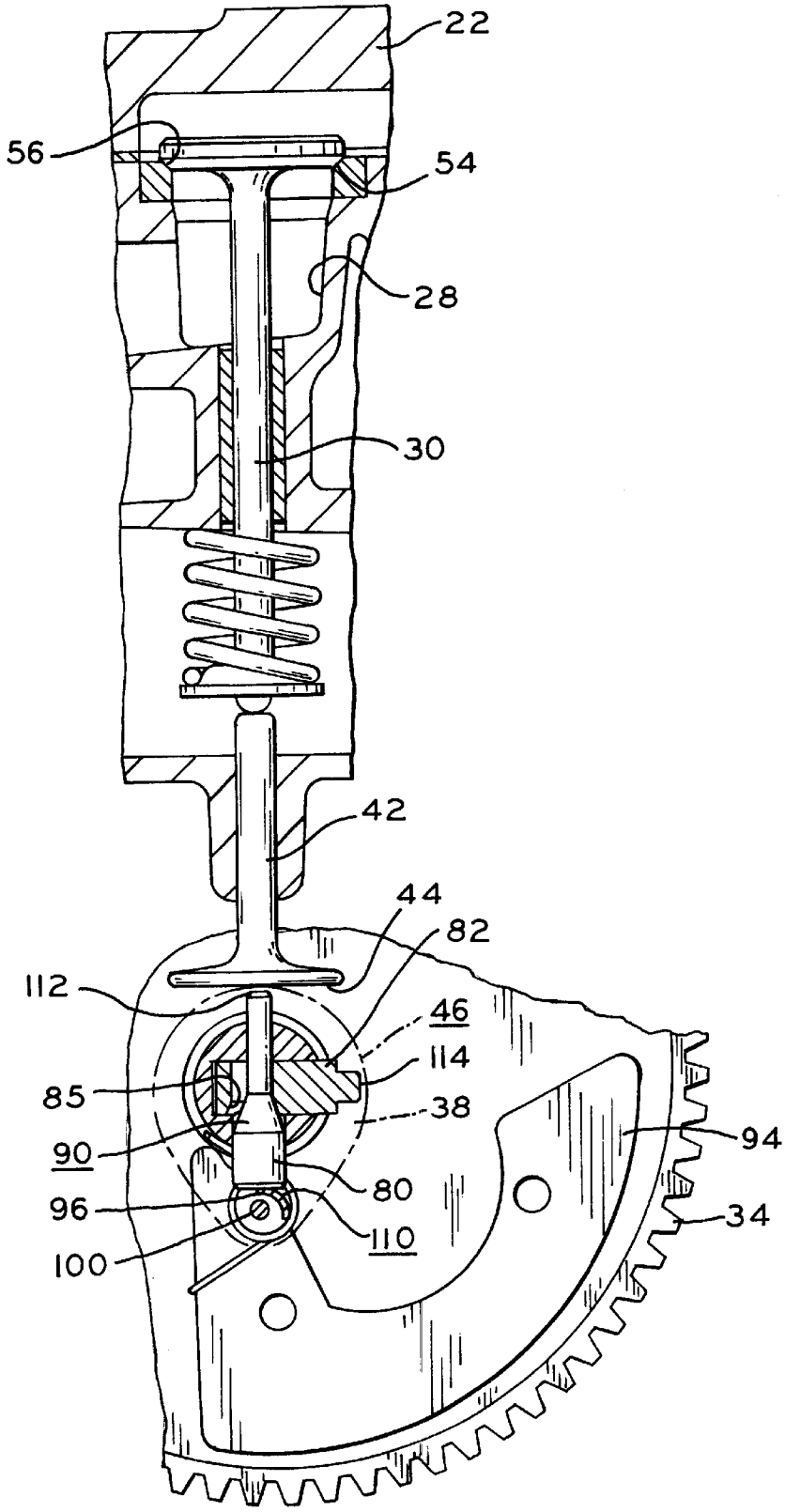
FIG. 6 is a fragmentary sectional view of the engine shown in FIG. 1, illustrating the compression and vacuum release assembly in the run position, depicting the compression and vacuum release members recessed below the surface of the cam lobe and the flyweight outwardly pivoted.

In contrast, and as best seen in FIG. 6, while device 12 is in its inoperative position, which may be generally designated as the "run" position of the engine, the rotation of camshaft assembly 36 at running speed causes normal operation of valve 30, so that valve 30 opens and closes in timed periodic relation with the travel of piston 18 according to conventional engine timing practice. Coincidentally, lifting portions 112 and 114 of compression and vacuum release pins 80 and 82 are receded below the bearing surface 46 of exhaust lobe 38 and valve lift is solely dependent on the contour of bearing surface 46 of cam lobe 38.

Exhaust lobe 38 is adapted to open valve 30 near the end of the power stroke and to hold the same open during ascent of the piston on the exhaust stroke until the piston has moved slightly past top dead center. As camshaft lobe 38 continues to rotate, spring 58 forces cam follower 42 downwardly and valve 30 is reseated. Valve 30 is held closed during the ensuing intake, compression and power strokes. Intake camshaft lobe 40 is likewise of conventional fixed configuration to control the intake valve (not shown) such that it completely closes shortly after the piston begins its compression stroke and remains closed throughout the subsequent power and exhaut strokes, and reopening to admit the fuel mixture on the intake stroke. A conventional engine provides intake and exhaust valves normally closed during a major portion of the power stroke, resulting in cumbersome and physically demanding cranking of the engine because the piston must pull against a vacuum.

By incorporating the compression and vacuum release mechanism 12 within engine 10, compression and vacuum relief is successively achieved at cranking speeds to greatly reduce cranking effort and thereby facilitate starting. Moreover, the compression and vacuum release mechanism is responsive to engine speeds such that it is automatically rendered inoperative at engine running speeds such that there is no compression lost to decrease the efficiency of the engine when it is running under its own power.

Compression and vacuum release mechanism 12 affects the lift of exhaust valve 30 relative to rotation of crankshaft 16 as hereinafter described. Referring to FIG. 1, engine 10 provides four strokes of piston 18 to complete a cycle of operation of the engine, coinciding with 720° of rotation of crankshaft 16. On the intake stroke, piston 18 moves downwardly from the top of its travel (referred to as top dead center or TDC) to the bottom of its travel (referred to as bottom dead center or BDC). Intake valve (not shown) is opened and exhaust valve 30 is closed during the intake stroke. During the intake stroke, and at crankshaft running speed, a charge of air/fuel mixture: s drawn into cylinder 24 above the head of piston 18 and through the intake valve (not shown). Following the intake stroke both the intake and exhaust valves close and the compression stroke is started. Toward the middle of the compression stroke, approximately 110° of crankshaft rotation before TDC, for example, lifting portion 112 of mechanical compression release pin 80 lifts exhaust valve 30 to relieve cylinder pressure and then closes at about 60° before TDC. Following the compression stroke, piston 18 is urged toward BDC in the power stroke, which coincides with both intake and exhaust valves substantially closed. At approximately 60° of crankshaft rotation following TDC toward the end of the power stroke, lifting portion 114 of vacuum release pin 82 lifts exhaust valve 30 off of its seat and suction forces due to vacuum formed in cylinder 24 are relieved.

For instance, in an exemplary embodiment of the compression and vacuum release 12, the intake valve may have a lift of 0.2 inches during the intake stroke and exhaust valve may be lifted 0.03 inches, and held open for 50° of camshaft rotation, by mechanical compression release pin 80 during the compression stroke Specifically, the mechanical compression release opens the exhaust valve 30 at a crankshaft rotation of 110° prior to TDC and holds open exhaust valve 30 until crankshaft 16 is approximately 60° from TDC. The vacuum release activated by vacuum release pin 82 opens exhaust valve 30 a distance of 0.02 inches at a crankshaft rotation of 60° after TDC to vent suction caused by cylinder vacuum during the power stroke. Thus, the energy of the compressed air/fuel mixture is used to assist moving the piston during the power stroke. Lifting portion 114 of vacuum release pin 82 holds open exhaust valve 30 at 60° after TDC for a duration of 50° of crankshaft rotation.

The disclosed embodiment is not intended to be exhaustive or limit the invention to the precise forms disclosed in the detailed description. While the present invention has been described as having an exemplary design, the present invention can be further modified within the spirit and scope of this disclosure. Further, this application is intended to cover such departures from the present disclosure as come within known or customary practice in the art to which this invention pertains.

What is claimed is:

1. A four-stroke internal combustion engine, comprising:

a cylinder block including a cylinder therein and having a piston reciprocally disposed within said cylinder, said piston operably engaged with a crankshaft;

a camshaft;

at least one intake valve reciprocally driven by said camshaft;

at least one exhaust valve reciprocally driven by said camshaft; and a vacuum release mechanism, comprising:

an operating member reciprocally supported within said camshaft for translation along an axis;

a centrifugally actuated flyweight member engaged with said operating member, wherein rotation of said camshaft above engine cranking speeds causes said flyweight member to move said operating member from a first position to a second position; and a vacuum release member movably supported within said camshaft and in engagement with said operating member wherein translational movement of said operating member causes movement of said vacuum re ease member, said operating member and flyweight urged to said first position at engine cranking speeds and moved by said flyweight member through centrifugal force to said second position at engine running speeds;

said vacuum release member being in lifting engagement with one of said valves at said first position during at least a portion of the power stroke of said piston and out of lifting engagement with one of said valves at said second position.

2. The four-stroke internal combustion engine of claim 1, wherein said vacuum release member is reciprocally supported within said camshaft and is urged to translate through engagement with said operating member.

3. The four-stroke internal combustion engine of claim 1, wherein said operating member includes an operating surface and said vacuum release member is in translational tracking engagement with said operating surface through a contoured edge defined by said vacuum release member.

4. The four-stroke internal combustion engine of claim 3, wherein said operating member is a pin and said operating surface is a frustoconical step provided in a peripheral portion of said pin.

5. The four-stroke internal combustion engine of claim 4, wherein said vacuum release member comprises a second pin and said contoured edge is positioned along an entrance to a radially disposed aperture within said second pin.

6. The four-stroke internal combustion engine of claim 1, wherein said axis of translation of said operating member is radially arranged relative to an axially positioned axis of rotation of said camshaft.

7. The four-stroke internal combustion engine of claim 6, wherein said vacuum release member is movable along a second axis, said second axis is radially offset and substantially axially aligned relative to said axis of translation of said operating member.

8. The four-stroke internal combustion engine of claim 7, wherein said second axis and said axis of translation of said operating member are radially offset by about 90°.

9. The four-stroke internal combustion engine of claim 1, wherein said flyweight is rotatably attached to said camshaft, said flyweight includes a cammed portion in tracking engagement with said operating member.

10. The four-stroke internal combustion engine of claim 9, wherein said operating member is radially retained between said camshaft and said cammed portion of said flyweight.

11. The four-stroke internal combustion engine of claim 10, wherein said vacuum release member includes an aperture, said vacuum release member is retained within said camshaft by said operating member being extended through said aperture within said vacuum release member.

12. The four-stroke internal combustion engine of claim 9, wherein said flyweight is attached to a lateral surface of a cam lobe provided by said camshaft.

13. The four-stroke internal combustion engine of claim 1, wherein said vacuum release member is disposed between a cam lobe of said camshaft and a cam gear radially disposed about said camshaft.

14. The four-stroke internal combustion engine of claim 1 further comprising a compression release member attached to said operating member, wherein movement of said operating member urges said compression release member to be in lifting engagement with one of said valves at said first position during at least a portion of the compression stroke of said piston and out of lifting engagement with one of said valves at said second position.

15. The four-stroke internal combustion engine of claim 14, wherein said compression release member includes a lifting; portion and said vacuum release member includes a lifting portion, said lifting portions are in successive lifting engagement with said one of said valves in said first position, said lifting portions being radially separated by about 90°.

16. The four-stroke internal combustion engine of claim 1, wherein said flyweight is urged toward an axis of rotation of said camshaft by a spring, and wherein inward movement of said flyweight is at least partially influenced by said spring at engine speeds less than said engine running speeds.

17. The four-stroke internal combustion engine of claim 1, wherein said one of said valves is said exhaust valve.

18. A four-stroke internal combustion engine, comprising:

a cylinder block including a cylinder therein and having a piston reciprocally disposed within said cylinder, said piston operably engaged with a crankshaft;

a camshaft;

at least one intake valve reciprocally driven by said camshaft;

at least one exhaust valve reciprocally driven by said camshaft; and a compression and vacuum release mechanism, comprising:

an operating member reciprocally supported within said camshaft for translation along an axis;

a centrifugally actuated flyweight member engaged with said operating member, wherein rotation of said camshaft above engine cranking speeds causes said flyweight member to move said operating member, said operating member and flyweight member urged to a first position at engine cranking speeds and rotated by centrifugal force to a second position at engine running speeds;

a compression release: member movably supported within said camshaft and in lifting engagement with one of said valves at said first position coinciding with at least a portion of the compression stroke of said piston; and a vacuum release member movably supported by said camshaft and in engagement with said operating member wherein translational movement of said operating member causes movement of said vacuum release member, said vacuum release member being in lifting engagement with one of said valves at said first position coinciding with at least a portion of the power stroke of said piston, said compression release member and said vacuum release member successively attaining lifting engagement with one of said valves at said first position, said compression and vacuum release members being out of lifting engagement with one of said valves at said second position.

19. The four-stroke internal combustion engine of claim 18, wherein said vacuum release member is reciprocally supported within said camshaft and is urged to translate through engagement with said operating member.

20. The four-stroke internal combustion engine of claim 18, wherein said compression release member is attached to said operating member, said compression release member includes a lifting portion and said vacuum release member includes a lifting portion, said lifting portions are in successive lifting engagement with said one of said values in said first position, said lifting portions being radially separated by about 90°.

* * * * *

UNITED STATES PATENT AND TRADEMARK OFFICE

CERTIFICATE OF CORRECTION

PATENT NO. : 6,539,906 B2
DATED : April 1, 2003
INVENTOR(S) : Rado et al.

It is certified that error appears in the above-identified patent and that said Letters Patent is hereby corrected as shown below:

Column 8,
Line 47, delete “re ease” and substitute therefor -- release --

Column 9,
Line 48, after “lifting” delete -- ; --

Column 10,
Line 25, after “release” delete -- : --

Signed and Sealed this

First Day of July, 2003

JAMES E. ROGAN
*Director of the United States Patent and Trademark Office*